United States Patent [19]

Morita

[11] 4,453,294

[45] Jun. 12, 1984

[54] ENGAGEABLE ARTICLE USING PERMANENT MAGNET

[76] Inventor: Tamao Morita, 47-1, 6-chome, Arakawa, Arakawa-ku, Tokyo, Japan, 116

[21] Appl. No.: 477,838

[22] Filed: Mar. 25, 1983

Related U.S. Application Data

[63] Continuation of Ser. No. 309,762, Oct. 8, 1981, abandoned, which is a continuation of Ser. No. 89,134, Oct. 29, 1979, abandoned.

[51] Int. Cl.[3] ..... A44B 17/70; A44C 13/10

[52] U.S. Cl. ..... 24/303; 24/688

[58] Field of Search ..... 24/201 B, 303, 113 MP, 24/94; 292/231.5

[56] References Cited

U.S. PATENT DOCUMENTS

| | | | |
|---|---|---|---|
| 496,408 | 5/1893 | Hall | 24/94 |
| 1,829,361 | 10/1931 | Lane | 24/94 |
| 2,615,227 | 10/1952 | Hornik | 24/201 B |
| 2,815,236 | 12/1957 | Lowinski | 292/251 B |
| 3,086,268 | 4/1963 | Chaffin | 24/201 B |
| 3,141,216 | 7/1964 | Brett | 24/201 B |
| 3,324,821 | 6/1967 | Humiston | 24/201 B |
| 3,372,443 | 3/1968 | Dadonna | 24/201 B |
| 3,589,341 | 6/1971 | Krebs | 24/201 B |
| 4,021,891 | 5/1977 | Morita | 24/201 B |
| 4,200,852 | 4/1980 | Aoki | 24/201 B |

FOREIGN PATENT DOCUMENTS

| | | | |
|---|---|---|---|
| 281897 | 1/1931 | Italy | 24/113 MP |
| 250979 | 9/1947 | Switzerland | 24/113 MP |

*Primary Examiner*—Paul J. Hirsch

*Attorney, Agent, or Firm*—Holman & Stern

[57] ABSTRACT

A magnetic fastener using a permanent magnet. A first ferromagnetic plate and a permanent magnet attached thereto are mounted on a body of a handbag or the like, and a second ferromagnetic plate is mounted on a cover thereof so that the second ferromagnetic plate may be magnetically fastened to the first when the cover is closed.

6 Claims, 6 Drawing Figures

ENGAGEABLE ARTICLE USING PERMANENT MAGNET

This is a continuation of application Ser. No. 309,762, filed Oct. 8, 1981 (now abandoned), which in turn is a continuation of Ser. No. 89,134, filed Oct. 29, 1979 (now abandoned).

This application relates to U.S. patent application Ser. No. 492,159, filed May 11, 1983 which is a continuation of Ser. No. 222,904, filed Jan. 7, 1981, now abandoned, Ser. No. 446,211 filed Dec. 2, 1982, and design application Ser. No. 258,039 filed Apr. 27, 1981.

FIELD OF THE INVENTION

This invention relates to a magnetically engageable article comprising a permanent magnet member and a ferromagnetic plate member on each side thereof, the permanent magnet and one plate member being attached for use to a body and the other plate member being attached to a cover portion so that the article serves as a fastener in an opening and closing portion of a handbag or the like.

BRIEF SUMMARY OF THE INVENTION

It is a primary object of the present invention to provide an arrangement wherein ferromagnetic plates arranged on respective magnetic pole surfaces are placed in contact with each other, a magnetic circuit is formed only in said contact portion, and positive and firm magnetization and engagement are assured by a simple handling operation.

It is a further primary object of the present invention to provide an arrangement wherein simple mounting and magnetization can be applied to containers or other articles of which an opening and closing cover must be placed in engagement.

It is another object of the present invention to provide an arrangement which can materially simplify an engaging construction with a permanent magnet being a base to thereby reduce costs of manufacture and mounting.

It is a still another object of the present invention to provide an arrangement which can effectively avoid damage to a magnet by coating treatment of a peripheral surface of the magnet, particularly by coating of the magnet with a brass plate or the like and materially increase the aesthetics of the external appearance.

DESCRIPTION OF THE PREFERRED EMBODIMENTS

Figure 1:
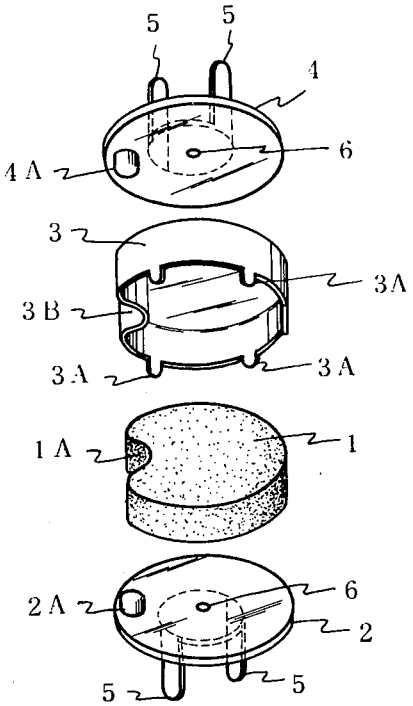
FIG. 1 is an exploded perspective view of one embodiment of a fastener in accordance with the present invention.

The present invention will be described in detail by way of a typical embodiment with reference to the drawings. Reference numerals 1, 11 and 21 designate different embodiments of a permenent magnet formed of metal ferromagnetic material or compound ferromagnetic material such as, typically, ferrite, pirotite FeS1.15, etc. The permanent magnet is of the short square shape or rectangular shape in plan, a partially concaved circular shape or ring shape and other suitable shapes determined according to the purpose of uses. The magnets 1, 11 and 21 are respectively placed and magnetized on ferromagnetic plates 2, 12 and 22 formed of iron, nickel cobalt or alloys and compounds thereof, or alloys and compounds of manganese and chrome, which are typical examples, and are fastened in a suitable manner. In the figures, substantially bottomed cylindrical non-magnetic plates 3, 13 and 23, which are molded into the same shape as the outer peripheral shape of the magnets 1, 11 and 21, are separately prepared so as to surround the remaining peripheral surface except the magnetized surfaces of the magnets 1, 11 and 21 to the plates 2, 12 and 22, and the magnets 1, 11 and 21 are surrounded by the plates 3, 13 and 23. Further, engageable members or prongs 3A—3A, 13A—13A and 23A—23A projected from the lower edges of the plates 3, 13 and 23 are bent towards or around the lower surfaces of the plates 2, 12 and 22 so as to curve around the peripheral side surfaces of the previously magnetized plates 2, 12 and 22. While the non-magnetic plates 3, 13 and 23 are generally formed of brass or synthetic resin material, to provide an improved appearance and to protect the magnets 1, 11 and 21 from damage, the material is not particularly limited to the above-named materials and other similar materials may be also used. It is natural that in order to provide the maximum force acting between magnetic poles, the plates 3, 13 and 23 are made as thin as possible and fitted so as to come into close contact with the magnets 1, 11 and 21. The ferromagnetic base plates 4, 14 and 24 are magnetizably disposed on another pole surface of the thus formed magnets 1, 11 and 21 with the non-magnetic plates 3, 13 and 23 interposed therebetween, and the base plates 4, 14 and 24 may partially and directly come into engagement with the plates 2, 12 and 22.

Figure 3:
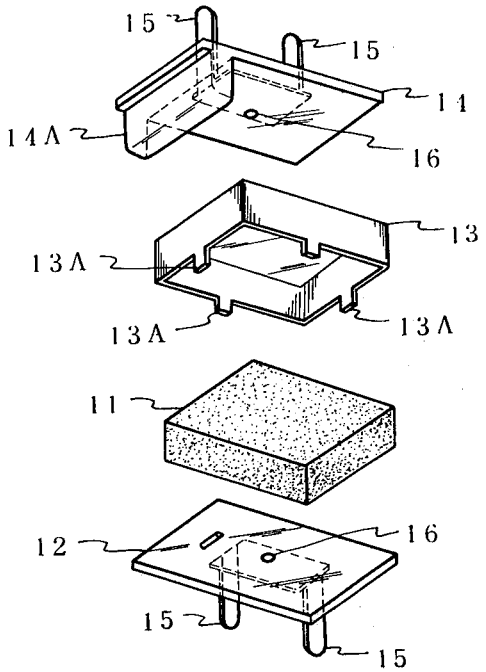
FIG. 3 is an exploded perspective view of another embodiment of the invention.
Figure 2:
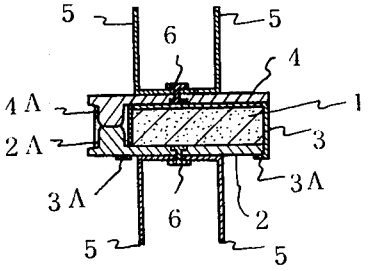
FIG. 2 is a sectional view of the embodiment shown in FIG. 1 in its assembled state.
Figure 4:
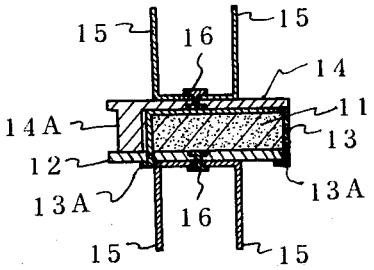
FIG. 4 is a sectional view of the embodiment shown in FIG. 3 in its assembled state.
Figure 5:
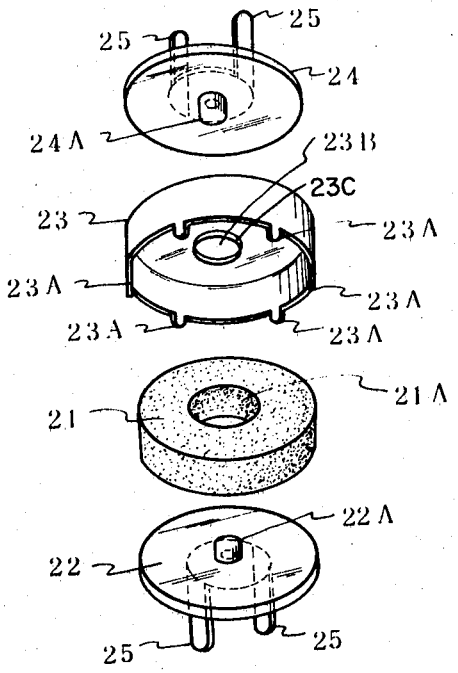
FIG. 5 is an exploded perspective view of a part which is a still another embodiment.
Figure 6:
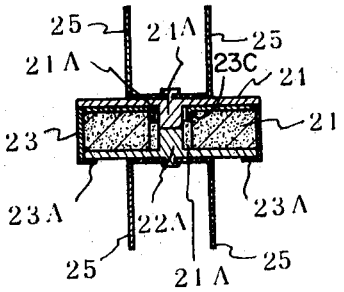
FIG. 6 is a sectional view of the embodiment shown in FIG. 5 in its assembled state.

Various procedures may be employed to place the plates 4, 14 and 24 in engagement with the plates 2, 12 and 22. A few typical procedures may be discussed below. First, as shown in FIGS. 1 and 2, engageable rods 2A and 4A are disposed to be protruded on ends opposed to the plates 2 and 4, respectively, and are slidably brought into contact or slidably brought into disengagement through engageable grooves 1A and 3B formed longitudinally of the magnet 1 and the plate 3. Secondly, as shown in FIGS. 3 and 4, one side edge of the plate 14 protrudes and is directed towards the plate 12 to form an engageable edge flange 14A. An additional engageable edge flanges may be provided to protrude and be directed from the plate 12, if necessary so that the peripheral side of the plate may be magnetized thereon. Thirdly, as shown in FIGS. 5 and 6, an engageable hole 21A is bored from one magnetic pole surface towards the other magnetic pole surface of the magnet 21 in the form of square or other four-cornered or circular shape to form an annular magnet 21. A hole 23B is bored in plate 23 corresponding to said hole 21A engageable rod like extensions 22A and 24A of the plates 22 and 24, respectively, disengageably extend through said holes 21A and 23B (in spaced relation to hole 21A by having smaller diameters. Extension 24A is held spaced from hole 21A by flange 23C and extension 22A is held spaced from hole 21A by its peripheral engagement with plate 23. If an engageable rod having the length to the plate 22 is protruded on the plate 24 as shown in FIGS. 3 and 4, similar effects may be achieved). However, change in design in lieu of the foregoing may also be applied. The ends of extensions 24A, 22A abut and since they do not contact hole 21A, the magnetic flux is guided through these extensions increasing the attachment force of the fastener.

It should be noted that basically, the rod 2A—rod 4A, rod 14A, and rod 22A—rod 24A are magnetized on the magnets 1, 11 and 21, respectively, in suitable magnetic spaced relation, and a magnetic circuit is formed only between the rod 2A—rod 4A, plate 12—rod 14A and rod 22A—rod 24A through the provision of magnetic spacing relative to the magnets 1, 11 and 21, thus achieving firm magnetization.

Opening and closing means for the tube constructed magnetizable engageable article, for example, containers such as a bag, a handbag or the like, or suitable securing means which may be attached to and used for other bodies are disposed on the plates 2, 12, 22 and plates 4, 14, 24. As one means therefor, approximately -shaped locking members 5 and 15 are fixed outwardly of not-opposed ends of the plates 2, 12 and 4 by means of rivets 6 and 16. Even when small-diameter rod portions of the rods 22A and 24A are inserted and suitably caulked, as shown in FIGS. 5 and 6, the same effect as the above may be obtained.

Prior art catches used to close the opening of the type as described such as buttons, hooks or strings are generally known. In the case of buttons, a button is inserted to engage a button hole bored in the opening so that a fixed side must be fastened by means of threads, and hence, the threads are apt to be snapped. In the case of hooks (or snaps), a spring is used to catch an insert projection, and therefore, during use for a long period of time, the spring becomes deteriorated resulting in a poor fit. Further, in the case of those articles which make use of a part of a permanent magnet of the type as described, most of them employ a ferromagnetic body which is merely brought into contact with an end of a permanent magnet, and as a consequence, a separate member need be provided to impair tension directed towards the contact surface of the magnet, thus likely inducing damage of the magnet and posing many difficulties in handling. The present invention has been achieved in view of those drawbacks noted above with respect to the prior art. In the present invention, a part of the ferromagnetic plate in contact with both ends forming magnetic poles is brought into direct contact to completely impair generation of a magnetic circuit in portions other than said contact portion to provide unification of a magnetic closed circuit. An attractive force is concentrated on said contact portions to provide firm attraction, thereby providing a magnetizable engaging article which is simple in construction and small in size. Moreover, in the mounting construction of the permanent magnets and plates, as described above, a movable member is not used in a fitting portion itself to secure solidity.

What is claimed is:

1. A magnetic fastener comprising: a magnetic member having a substantially circular cross-section, a first side and a second side of opposite polarities, and a substantially cylindrically shaped peripheral edge;

a cover member of non-magnetic material configurationally conforming and adjacent to said second side and said peripheral edge of said magnetic member so that it encloses said magnetic member except said first side;

a first ferromagnetic material member positioned against said first side of said magnetic member and having at least two prongs rigidly secured thereto and extending outwardly therefrom for attaching said first ferromagnetic member to a first surface;

means for securing edge portions of said first ferromagnetic material member to regions of said cover member of non-magnetic material in the vicinity of said peripheral edge; and a second ferromagnetic material member removably positioned against said non-magnetic cover member adjacent said second side comprising:

a base plate adjacent said non-magnetic plate, and an elongated projection extending from said base plate adjacent the periphery therof toward and contacting said first ferromagnetic material member, and a plurality of prongs rigidly secured to said base plate and extending outwardly therefrom for attaching said second ferromagnetic member to a second surface, and futher comprising a concave arcuately shaped groove in said peripheral edge of said magnetic member extending between said first and second sides and a concave arcuately shaped groove in the peripheral edge of said cover conforming thereto, said elongated projection being substantially commensurate in shape with and adapted to be received in said groove in said cover in radially spaced relationship thereto and having a substantially circular cross-section of greater dimension than the thickness of said base plate.

2. The magnetic fastener as claimed in claim 1, wherein said securing means comprises locking tabs on the peripheral edge of said cover member of non-magnetic material, said locking members being bent around edge portions of said first ferromanetic material member to secure said member to said cover member and thereby completely enclose said magnetic member.

3. The magnetic fastener as claimed in claim 2, wherein a second elongated projection is provided on said first ferromagnetic material member having substantially the same shape and size as said first projection extending in said groove for contacting engagement with said first elongated projection and correspondingly radially spaced with respect to said groove.

4. The magnetic fastener as claimed in claim 3, wherein said elongated projections are cylindrical in shape and the cross-section of each said groove is a circular segment.

5. A magnetic fastener comprising: a magnetic member having a first side and a second side of opposite polarities, and a peripheral edge;

a cover member of non-magnetic material configurationally conforming and adjacent to said second side and said peripheral edge of said magnetic member so that it encloses said magnetic member except said first side;

a first ferromagnetic material member positioned against said first side of said magnetic member and having at least two prongs rigidly secured thereto and extending outwardly therefrom for attaching said first ferromagnetic member to a first surface;

means for securing edge portions of said first ferromagnetic material member to regions of said cover member of non-magnetic material in the vicinity of said peripheral edge; and a second ferromagnetic material member removably positioned against said non-magnetic cover member adjacent said second side comprising:

a base plate adjacent said non-magnetic plate, and an elongated projection extending from said base plate toward and contacting said first ferromagnetic material member, and a plurality of prongs rigidly secured to said base plate and extending outwardly therefrom for attaching said second ferromagnetic member to a second surface, said securing means comprising locking tabs on the peripheral edge of said cover member of non-magnetic material, said locking tabs being bent around edge portions of said first ferromagnetic material member to secure said first ferromagnetic material member to said cover member and thereby completely enclose said magnetic member, said magnetic member, cover member and first and second ferromagnetic members being substantially rectangular in cross-section so that said peripheral edges meet at substantially right angles, and said elongated projection is substantially rectangular in cross-section and extends along one peripheral edge of said cover member in close spaced proximity thereto for the entire distance between said first and second ferromagnetic members, and the cross-sectional dimensions of said projection are greater than the thickness of said base plate.

6. A magnetic fastener comprising: a magnetic member having a first side and a second side of opposite polarities, a substantially central hole extending between said sides, and a peripheral edge;

a cover member of non-magnetic material configurationally conforming and adjacent to said second side and said peripheral edge of said magnetic member so that it encloses said magnetic member except said first side; a substantially central hole in said cover member coaxial with said hole in said magnetic member, a cylindrical flange on said cover member at said hole therein extending axially into said hole in said magnetic member and in engagement therewith to retain said magnetic member in radially fixed relationship with respect to said cover member;

a first ferromagnetic material member positioned against said first side of said magnetic member, and having at least two prongs rigidly secured thereto and extending outwardly therefrom for attaching said first ferromagnetic member to a first surface;

means for securing edge portions of said first ferromagnetic material member to regions of said cover member of non-magnetic material in the vicinity of said peripheral edge; and a second ferromagnetic material member removably positionable against said non-magnetic cover member adjacent said second side comprising:

a base plate adapted to engage said non-magnetic cover, and an elongated projection extending substantially centrally from said base plate through said holes in spaced relation to said hole in said magnetic member toward and contacting said first ferromagnetic material member, and a plurality of prongs rigidly secured to said base plate and extending outwardly therefrom for attaching said second ferromagnetic member to a second surface, said securing means comprising locking tabs on the peripheral edge of said cover member of non-magnetic material, said locking tabs being bent around edge portions of said first ferromagnetic material member to secure said member to said cover member and thereby substantially enclose said magnetic member.

* * * * *

US004453294B1

REEXAMINATION CERTIFICATE (2957th)

United States Patent [19] [11] B2 4,453,294

Morita [45] Certificate Issued Jul. 23, 1996

[54] ENGAGEABLE ARTICLE USING PERMANENT MAGNET

[75] Inventor: Tamao Morita, Tokyo, Japan

[73] Assignee: Amsco, Inc., Brooklyn, N.Y.

Reexamination Request:
No. 90/003,855, Jun. 12, 1995

Reexamination Certificate for:

| | |
|---|---|
| Patent No.: | **4,453,294** |
| Issued: | **May 28, 1991** |
| Appl. No.: | **477,838** |
| Filed: | **Mar. 25, 1983** |

Reexamination Certificate B1 4,453,294 issued May 28, 1991

Related U.S. Application Data

[63] Continuation of Ser. No. 309,762, Oct. 8, 1981, abandoned, which is a continuation of Ser. No. 689,134, Oct. 29, 1979, abandoned.

[51] Int. Cl.[6] ..... A44B 17/00

[52] U.S. Cl. ..... 24/303; 24/688; 24/66.1; 292/251.5

[58] Field of Search ..... 24/303, 688, 66.1, 24/113 MP, 94; 292/251.5

[56] References Cited

U.S. PATENT DOCUMENTS 4,021,891 5/1977 Morita .

FOREIGN PATENT DOCUMENTS

| | | |
|---|---|---|
| 44-27953 | 11/1969 | Japan . |
| 50-165117 | 6/1977 | Japan . |
| D973682 | 1/1977 | United Kingdom . |
| 1519246 | 7/1978 | United Kingdom . |

*Primary Examiner*—Victor N. Sakran

[57] ABSTRACT

A magnetic fastener using a permanent magnet. A first ferromagnetic plate and a permanent magnet attached thereto are mounted on a body of a handbag or the like, and a second ferromagnetic plate is mounted on a cover thereof so that the second ferromagnetic plate may be magnetically fastened to the first when the cover is closed.

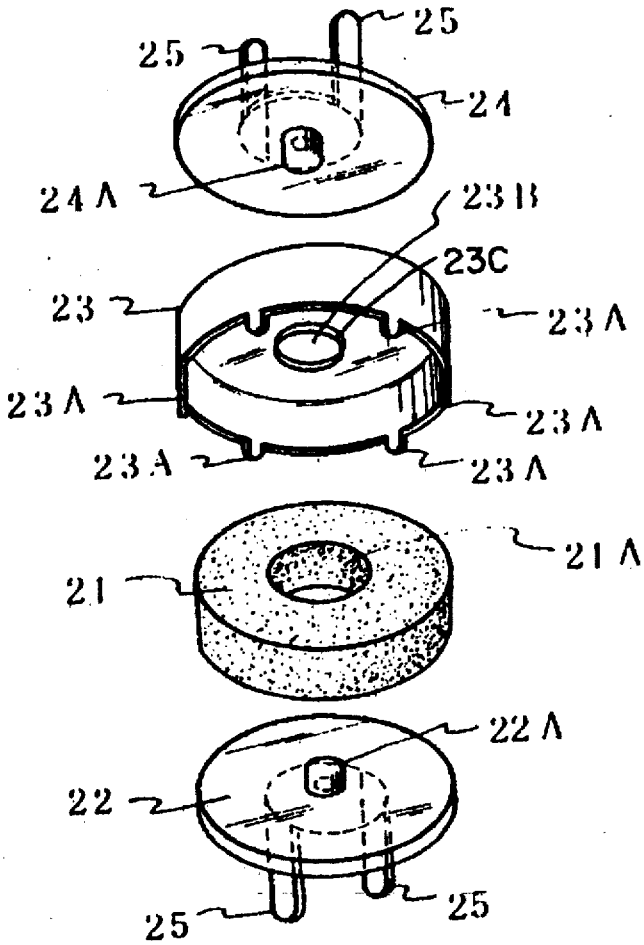

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–6 and 7 are confirmed.

* * * * *